US008620184B2

(12) United States Patent
Miyaji et al.

(10) Patent No.: US 8,620,184 B2
(45) Date of Patent: Dec. 31, 2013

(54) IMAGE FORMING APPARATUS HAVING A POSITIVELY CHARGED SINGLE LAYER TYPE ELECTROPHOTOGRAPHIC PHOTORECEPTOR

(75) Inventors: Shinki Miyaji, Osaka (JP); Masaki Kadota, Osaka (JP); Masahito Ishino, Osaka (JP); Yoshitaka Imanaka, Osaka (JP); Hiroka Itani, Osaka (JP)

(73) Assignee: Kyocera Mita Corporation (JP)

( * ) Notice: Subject to any disclaimer, the term of this patent is extended or adjusted under 35 U.S.C. 154(b) by 0 days.

(21) Appl. No.: 13/152,027

(22) Filed: Jun. 2, 2011

(65) Prior Publication Data

US 2011/0299888 A1 Dec. 8, 2011

(30) Foreign Application Priority Data

Jun. 4, 2010 (JP) ..... 2010-129124
Dec. 27, 2010 (JP) ..... 2010-289758

(51) Int. Cl.
*G03G 15/00* (2006.01)
*G03G 15/02* (2006.01)

(52) U.S. Cl.
USPC ..... 399/159; 399/168; 399/176

(58) Field of Classification Search
USPC ..... 399/159, 176, 168
See application file for complete search history.

(56) References Cited

U.S. PATENT DOCUMENTS

| | | | | |
|---|---|---|---|---|
| 5,382,489 | A * | 1/1995 | Ojima et al. | 430/96 |
| 2002/0045119 | A1 | 4/2002 | Azuma et al. | |
| 2003/0134213 | A1 | 7/2003 | Omokawa | |
| 2003/0180073 | A1 | 9/2003 | Ishiyama et al. | |
| 2004/0057749 | A1 | 3/2004 | Saito et al. | |
| 2006/0166117 | A1* | 7/2006 | Azuma et al. | 430/74 |
| 2009/0005225 | A1* | 1/2009 | Tsuchiya et al. | 492/56 |
| 2009/0129817 | A1* | 5/2009 | Obata et al. | 399/174 |

FOREIGN PATENT DOCUMENTS

| | | |
|---|---|---|
| JP | 5-303259 | 11/1993 |
| JP | 2002-72511 | 3/2002 |
| JP | 2002-174919 | 6/2002 |
| JP | 2004133067 | 4/2004 |
| JP | 2007-271731 | 10/2007 |

* cited by examiner

*Primary Examiner* — Billy J Lactaoen
(74) *Attorney, Agent, or Firm* — Gerald E. Hespos; Michael J. Porco; Matthew T. Hespos

(57) ABSTRACT

An image forming apparatus has: a positively-charged single layer type electrophotographic photoreceptor; a charging device with a contact charging roller for charging a surface of the photoreceptor; an exposure device for exposing the charged surface to light to form an electrostatic latent image on the surface of the photoreceptor; a developing device for developing the electrostatic latent image into a toner image; and a transfer device for transferring the toner image to a transferred body. The photoreceptor has a conductive substrate and a photosensitive layer that contains a charge generating agent, a charge transport agent and a binder resin. The binder resin has a yield point strain of 9 to 29%, and the contact charging roller has a conductive layer with a thickness of 1 mm to 3 mm. The image forming apparatus is environmentally responsive and having a long-lasting positively-charged single layer type photoreceptor and charging roller.

5 Claims, 10 Drawing Sheets

IMAGE FORMING APPARATUS HAVING A POSITIVELY CHARGED SINGLE LAYER TYPE ELECTROPHOTOGRAPHIC PHOTORECEPTOR

BACKGROUND OF THE INVENTION

1. Field of the Invention

The present invention relates to an image forming apparatus that has a positively-charged single layer type electrophotographic photoreceptor and a contact charging member.

2. Description of the Related Art

A negatively-charged multilayered photoreceptor and a positively-charged single layer type photoreceptor are known as photoreceptors of an eletrophotographic image forming apparatus. Among these, the positively-charged single layer type photoreceptor is designed to last long because its film thickness can be increased relatively easily. In addition, compared to the multilayered photoreceptor, the single layer type photoreceptor can be produced more easily at a lower cost since it requires only a coating process for a single layer.

Furthermore, in consideration of the environment, a contact charging system that performs, for example, roller charging using a rubber roller has been widely used in the electrophotographic image forming apparatuses, as an alternative to a scorotron charging system (non-contact system) that generates a large amount of ozone. This roller charging where a photoreceptor is charged by discharge in a small gap between the photoreceptor and a roller realizes a reduction of the ozone.

It is considered that an environmentally responsive electrophotographic image forming apparatus can be designed by a combination of a single layer type photoreceptor and the roller charging. However, although the contact charging system that produces less ozone is widespread in the market in the field of a system using a negatively-charged multilayered photoreceptor, the conventional scorotron charging system has still been used in a system using a positively-charged single layer type photoreceptor that produces less ozone as compared to the negatively-charged multilayered photoreceptor.

As environmental awareness increases in recent years, however, the amount of ozone that is discharged by the scorotron charging system in the system using the positively-charged single layer type photoreceptor is not acceptable in the market. For this reason, the system using the positively-charged single layer type photoreceptor also needs to employ the contact charging system.

In addition, increasing the life-span of a photoreceptor leads to a reduction in wastes, which is also highly desired in the market. However, employing the contact charging system facilitates peeling of a film of the photoreceptor, reducing the life-span of not only the photoreceptor but also a contact charging member by half.

SUMMARY OF THE INVENTION

The present invention was contrived in view of these circumstances, and an object thereof is to provide an environmentally responsive image forming apparatus that has a long-lasting positively-charged single layer type photoreceptor and charging roller.

As a result of the earnest research, the inventors of the present invention have discovered that the object described above can be accomplished by using the following image forming apparatus, and completed the present invention after a great deal of research based on such discovery.

Specifically, an image forming apparatus according to one aspect of the present invention has: a positively-charged single layer type electrophotographic photoreceptor; a charging device that has a contact charging member for charging a surface of the photoreceptor; an exposure device for exposing the charged surface of the photoreceptor to light to form an electrostatic latent image on the surface of the photoreceptor; a developing device for developing the electrostatic latent image into a toner image; and a transfer device for transferring the toner image from the photoreceptor to a transferred body, wherein the positively-charged single layer type electrophotographic photoreceptor has a conductive substrate and a photosensitive layer, the photosensitive layer contains a charge generating agent, a charge transport agent and a binder resin together, the binder resin having a yield strain of 9 to 29%, and the contact charging member is a charging roller that has a conductive layer with a thickness of 1 to 3 mm.

Further objects and specific advantages provided by the present invention will be clarified by the following descriptions of embodiments.

DETAILED DESCRIPTION OF THE PREFERRED EMBODIMENTS

Figure 1:
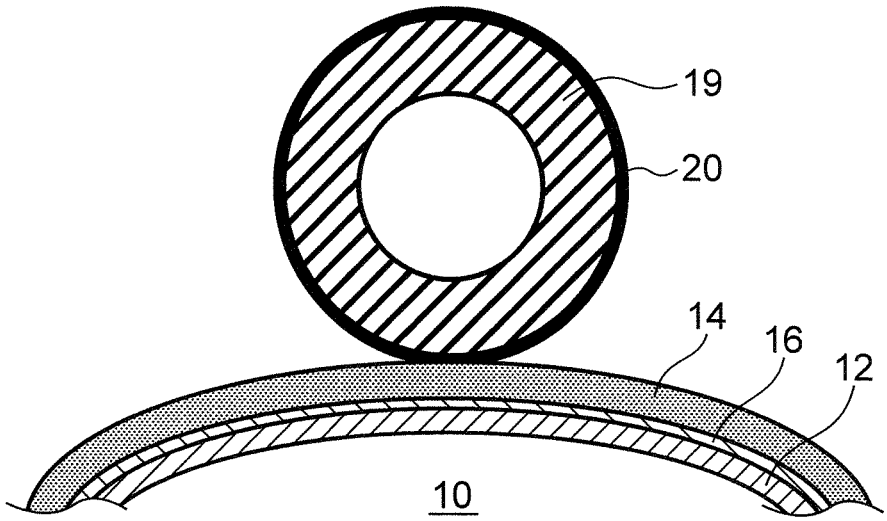
FIG. 1 is a schematic cross-sectional diagram showing a positively-charged single layer type electrophotographic photoreceptor and a charging roller according to an embodiment of the present invention.

Embodiments of the present invention are now described hereinafter, but the present invention is not limited thereto.

[Image Forming Apparatus]

An image forming apparatus according to the present embodiment has: a positively-charged single layer type electrophotographic photoreceptor; a charging device that has a contact charging member for charging a surface of the photoreceptor; an exposure device for exposing the charged surface of the photoreceptor to light to form an electrostatic latent image on the surface of the photoreceptor; a developing device for developing the electrostatic latent image into a toner image; and a transfer device for transferring the toner image from the photoreceptor to a transferred body, wherein the positively-charged single layer type electrophotographic photoreceptor has a conductive substrate and a photosensitive layer, the photosensitive layer contains a charge generating agent, a charge transport agent and a binder resin together, the binder resin having a yield point strain of 9 to 29%, and the contact charging member is a charging roller that has a conductive layer with a thickness of 1 to 3 mm.

According to such an image forming apparatus having the positively-charged single layer type photoreceptor and the charging roller capable of reducing the amount of ozone generated, the conventional problems such as wearing of the photoreceptor and peeling of the film of the photoreceptor are prevented to increase the life-span of the photoreceptor, and the increase of the resistance of the charging roller can be prevented to increase the life-span of the charging roller as well. In other words, the image forming apparatus of the present invention accomplishes excellent durability, generates less ozone, and is extremely useful in terms of environmental responsiveness and industrial applicability.

(Charging Device)

The charging device used in the present embodiment has the contact charging member for charging a surface of the photoreceptor. As the contact charging member, the present embodiment uses a contact charging roller (rubber roller), which has a conductive layer with a thickness of 1 to 3 mm. The external diameter of the charging roller is not particularly limited but is approximately 8 to 14 mm. This charging roller is rotated by the rotation of a photoreceptor drum while contacting with the photoreceptor drum, so as to charge a circumferential surface (surface) of the photoreceptor drum.

Specific configurations of the charging roller are not particularly limited as long as the thickness of the conductive layer falls within the ranges described above; however, examples of the charging roller include the one that has a cored bar supported rotatably, an (ion) conductive layer 19 formed on a surface part thereof (i.e., on the cored bar), and voltage application means for applying a voltage to the cored bar. With the application of a voltage from the voltage application means to the cored bar, the charging device with such a charging roller can charge the surface of the photoreceptor drum that is in contact with the charging roller via the conductive layer.

The thickness of the conductive layer is 1.0 to 3.0 mm, as described above. When the thickness of the conductive layer is less than 1 mm, the resistance of the charging roller reaches a limit value immediately, and the effects of the present invention cannot be obtained. When the thickness of the conductive layer exceeds 3.0 mm, the pressure of the conductive layer deforms the photoreceptor, and the shape of the photoreceptor cannot be stabilized upon manufacture thereof.

In the present embodiment, the voltage application means applies a voltage so that an electrification current value of the charging roller becomes approximately 20 to 30 μA at first (when starting printing). However, because the electrostatic capacitance of the photoreceptor increases as the number of prints increases (as the photoreceptor drums become worn away), the electrification current value of the charging roller becomes approximately 80 to 100 μA by the time when the resistance of the charging roller reaches the upper limit (when the number of prints exceeds 200,000). When the photoreceptor becomes worn away by printing tens of thousands of pages, the photoreceptor can no longer be charged unless a number of currents are applied to the charging roller, but the resistance value of a conventional charging roller increases as soon as a current as large as 80 to 100 μA is conducted to the charging roller. For this reason, the conventional charging roller cannot be used for a long period of time at such current values. In this sense, the present embodiment is extremely advantageous because many currents can be applied to its charging roller for a log period of time.

Normally, when the resistance value of a charging roller exceeds $10^7\Omega$, the surface potential thereof decreases. Therefore, the life of this charging roller ends once the resistance value thereof exceeds approximately $10^7\Omega$. This value is the upper limit resistance of the charging roller. In the present embodiment, voltages can be applied continuously to the charging roller when its life ends, until the electrification current value thereof becomes three to five times of an initial electrification current value of the charging roller, which is obtained upon the beginning of printing (0 print).

As described above, a significantly long-lasting charging roller can be obtained. In addition, compared to the conventional system, more currents can be applied to the charging roller for a long period of time, and a long-lasting image forming apparatus can be obtained.

According to the configuration described above, the system using the positively-charged single layer type electrophotographic photoreceptor can adopt the contact charging system, realizing a long-lasting environmentally responsive image forming apparatus that has a long-lasting photoreceptor and charging roller.

The following reasons are considered regarding this fact.

Use of the photoreceptor according to the present invention can improve the resistance thereof and prevent peeling of the film of the photoreceptor in a contact charging system that imposes a great load on the photoreceptor.

Basically, the more a normal charging roller is used, that is, the longer the time to conduct electricity to the charging roller, the higher the resistance value of the charging roller becomes, ending the life of the charging roller once the resistance value thereof exceeds the limit value. However, the configuration described above can realize the application of a number of currents to the charging roller of the present embodiment for a long period of time until the resistance value of the charging roller reaches the upper limit resistance value.

In the image forming apparatus described above, it is preferred that an initial electric resistance value of the charging roller be $10^5$ to $10^6\Omega$. According to this configuration, stable charging can be performed without causing uneven charging or current leakage to the photoreceptor (dielectric breakdown of the photosensitive layer).

It is also preferred that the conductive layer be made of conductive rubber.

Specific examples of the rubber material used in the present embodiment include epichlorohydrin rubber, urethane rubber, silicon rubber, nitrile rubber (NBR), and CR rubber. Above all, epichlorohydrin rubber and nitrile rubber (NBR) are preferably used as the rubber material due to their resistance to ozone, low-temperature characteristics and electric conductive uniformity (the difference in resistance is small depending on places).

According to this configuration, not only is it possible to prevent the resistance of the charging roller from increasing, but also the life of the charging roller can be increased reliably.

In the present embodiment, an ion conductive agent is added to the rubber material, and thus obtained mixture is used as the ion conductive rubber in the conductive layer. A known ion conductive agent can be used in the field to which the present invention belongs, and specific examples thereof include lithium ion and tetrabutylammonium. When adding the ion conductive agent to the rubber material, the amount of the ion conductive agent to be mixed in is, normally, 1 to 5 parts by mass or preferably 1 to 3 parts by mass with respect to 100 parts by mass of the rubber material.

The conductive layer exerts the effects thereof by having an additional substance such as carbon black, conductive (metallic) filler or the like.

Note that the conductive layer may be a solid layer or a foamed layer. A solid conductive layer is preferably used because uneven charging hardly occurs.

Resin coating 20 may be applied to the surface of the conductive layer 19 (FIG. 1). For example, urethane, nylon or other type of resin can be used in the resin coating 20. When applying the resin coating to the surface of the conductive layer, the thickness of the resin coating 20 is normally approximately 10 to 100 μm. However, the resin coating may not necessarily be applied to the surface layer of the conductive layer 19. Since the conductive layer is in the form of a tube or has a single layer structure, the surface layer thereof can be chemically processed by means of isocyanate processing.

The voltage applied by the voltage application means is preferably a DC voltage, so that the photosensitive layer can be made more resistant even when the positively-charged single layer type electrophotographic photoreceptor, described hereinafter, is used. More specifically, compared to when applying the charging roller with an AC voltage or a superimposed voltage in which an AC voltage is superimposed on a DC voltage, applying the charging roller only with a DC voltage can make the photosensitive layer more resistant.

Although the application of an AC voltage can uniform the potential of the surface (circumferential surface) of an image carrier by charging the surface of the image carrier, the image forming apparatus uses the contact charging device in place of a non-contact charging device so as to be able to charge the surface of the image carrier evenly with the application of a DC current alone. Therefore, the image forming apparatus can not only form excellent images by applying only a DC current to the charging roller, but also make the photosensitive layer more resistant.

(Photoreceptor)

The positively-charged single layer type electrophotographic photoreceptor (simply referred to as "photoreceptor" or "single layer type photoreceptor," hereinafter) used in the present embodiment is a layer that has the conductive substrate and the photosensitive layer, wherein the photosensitive layer contains a charge generating agent, a charge transport agent and a binder resin together, and the binder resin has a yield point strain of 9 to 29% (or the photoreceptor surface layer has a yield point strain of 5 to 25%).

Although use of the binder resin having the yield point strain within the abovementioned range is apt to degrade the performance of the photosensitive layer, the photosensitive layer can be made more resistant.

The contact type charging device, which comes into contact with the photoreceptor to charge the photoreceptor, tends to impose a great load on the photoreceptor, but charging the photoreceptor by coming into contact therewith can charge the photosensitive layer appropriately. Therefore, the photoreceptor can be charged appropriately even when the photoreceptor has a photosensitive layer the sensitivity of which is supposedly somewhat reduced.

Use of the binder resin having the yield point strain within the abovementioned range can not only make the photosensitive layer resistant as described above, but also adequately prevent the photosensitive layer from separating from a layer therebelow such as, for example, the conductive substrate, due to its low adhesion.

As described above, a combination of such a photoreceptor and the charging roller described above can not only form preferred images for a long period of time but also obtain a highly durable image forming apparatus.

The yield point strain is described next. Two sample materials are fixed to each other at their ends by using two zippers. The samples are stretched by moving one of the zippers at a constant speed, to detect stress. When illustrating a stress-strain relationship using a curve, the strain and the stress are in a proportionate relationship, in which the samples become loose due to viscous components thereof as the strain increases, thereby obtaining a maximal value of the stress. This point is the yield point. The yield point strain is a value representing the degree of the strain on each sample at the yield point. In the present embodiment, the yield point can be measured by a known method, such as a viscoelasticity measuring device, which is described in the examples hereinafter.

The photoreceptor used in the present embodiment is not particularly limited as long as it is a single layer type electrophotographic photoreceptor that has the configurations described above, such as the conductive substrate and the photosensitive layer, wherein the photosensitive layer contains the charge generating agent, the charge transport agent and the binder resin together and the yield point strain of the binder resin is 9 to 29% (or the photoreceptor surface layer has a yield point strain of 5 to 25%).

Figure 2A:
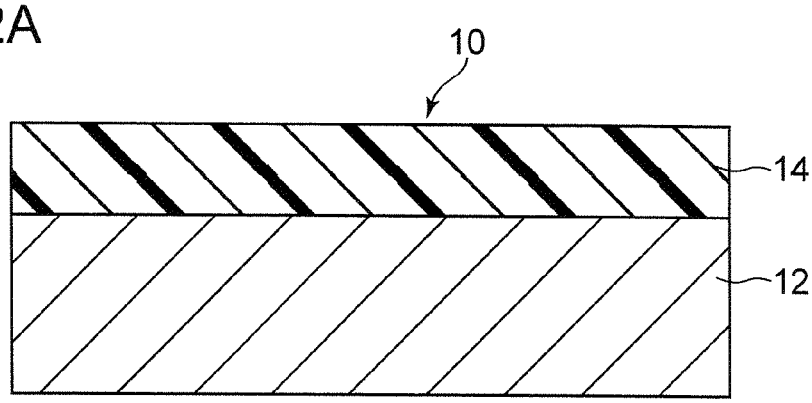
FIGS. 2A to 2C are schematic cross-sectional diagrams showing a structure of the positively-charged single layer type electrophotographic photoreceptor according to the embodiment of the present invention.
Figure 2B:
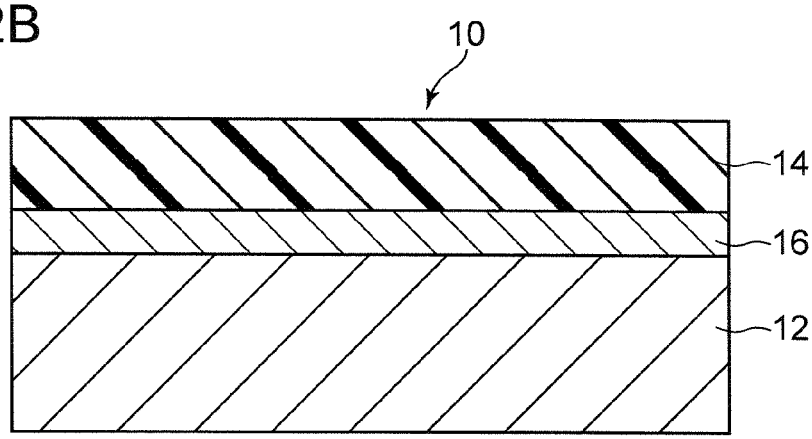
Figure 2C:
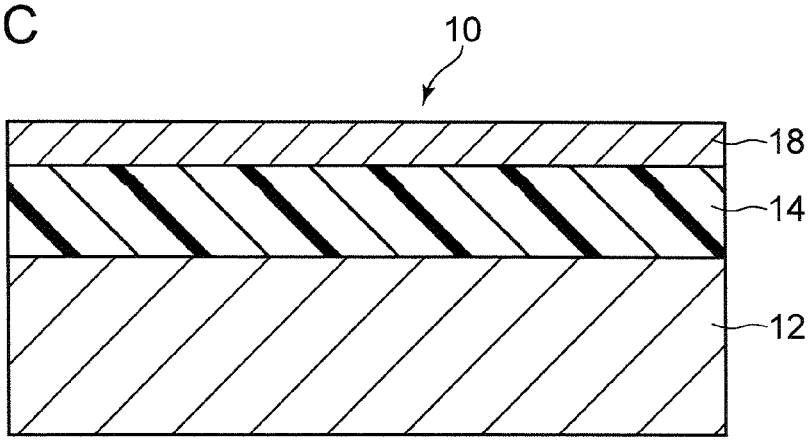

More specifically, for example, the single layer type electrophotographic photoreceptor may have a conductive substrate and a photosensitive layer 14 as shown in FIGS. 2A to 2C, wherein the photosensitive layer 14 is a single layer type photoreceptor 10 that contains a charge generating agent, a charge transport agent and a binder resin together. The single layer type electrophotographic photoreceptor may have layers other than the photosensitive layer and the conductive substrate.

For instance, the conductive substrate 12 may have the photosensitive layer 14 directly thereon, as shown in FIG. 2A, or an interlayer 16 may be provided between the conductive substrate and the photosensitive layer 14, as shown in FIG. 2B. The photosensitive layer 14 may be exposed in the form of an outermost layer, as shown in FIG. 2A or FIG. 2B, or a protective layer 18 may be provided on the photosensitive layer 14, as shown in FIG. 2C.

Although not particularly limited as described above, the single layer type photoreceptor 10 preferably has the interlayer between the conductive substrate 12 and the photosensitive layer 14 as shown in FIG. 2B, wherein the interlayer 16 is a high-resistivity layer that has a resistance value higher than that of the conductive substrate 12. Such a configuration can prevent the occurrence of current leakage from the charging roller of the charging device, which is likely to occur when the film of the photoreceptor becomes thin due to prolonged use thereof.

The high-resistivity layer is not particularly limited as long as it has a resistance value higher than that of the conductive substrate 12 and is capable of preventing the occurrence of the leakage. Examples of the high-resistivity layer include an alumite layer, aluminum iodide film, tin oxide film, indium oxide film, and titanium oxide film.

The thickness of the high-resistivity layer is preferably, for example, 1 to 3 μm, depending on the material and the like of the high-resistivity layer.

The conductive substrate and the photosensitive layer of the positively-charged single layer type electrophotographic photoreceptor according to the present embodiment are described hereinafter in detail.

[Conductive Substrate]

The conductive substrate is not particularly limited as long as it can be used as a conductive substrate of an electrophotographic photoreceptor. In other words, the conductive substrate can be, for example, the one in which at least a surface part is made of a conductive material. More specifically, for example, the conductive substrate may be made of a conductive material or obtained by coating a plastic surface with a conductive material. Examples of the conductive material include aluminum, iron, copper, tin, platinum, silver, vanadium, molybdenum, chromium, cadmium, titanium, nickel, palladium, indium, stainless steel, and brass. As the conductive material, at least one of the abovementioned conductive materials may be used, or alloy with a combination of two or more of the above-mentioned conductive materials may be used. It is preferred that the conductive substrate be made of aluminum or aluminum alloy, so that a photoreceptor capable of forming excellent images can be provided. This is because a charge can be moved well from the photosensitive layer to the conductive substrate.

The shape of the conductive substrate is not particularly limited. In other words, the conductive substrate may be in the form of a sheet or a drum. Specifically, the conductive substrate may be in the form of a sheet or a drum in accordance with the structure of the image forming apparatus to which the conductive substrate is applied.

[Photosensitive Layer]

The photosensitive layer used in the present embodiment can be used as a photosensitive layer of a single layer type electrophotographic photoreceptor. This photosensitive layer contains a charge generating agent, a charge transport agent and a binder resin, as described above. Specific examples of a structure of the photosensitive layer include the structure of the photosensitive layer shown in FIGS. 2A to 2C, as described earlier.

The charge generating agent, the charge transport agent and the binder resin contained in the photosensitive layer are not particularly limited, but the following examples can be used.

(Charge Generating Agent)

The charge generating agent is not particularly limited as long as it can be used as a charge generating agent of a single layer type electrophotographic photoreceptor. Specific examples of the charge generating agent include X-type phthalocyanine (x-H2Pc) expressed by the following formula (1) or (2), Y-type oxo-titanyl phthalocyanine (Y-TiOPc), a perylene pigment, a bis-azo pigment, a dithioketo-pyrrolo-pyrrole pigment, a metal-free naphthalocyanine pigment, a metal naphthalocyanine pigment, a squaraine pigment, a tris-azo pigment, an indigo pigment, an azlenium pigment, a cyanine pigment, inorganic photoconductive powders such as selenium, selenium-tellurium, selenium-arsenic, cadmium sulfide and amorphous silicon, pyrylium salt, an anthanthrone pigment, a triphenylmethane pigment, a threne pigment, a toluidine pigment, a pyrazoline pigment, and a quinacridone pigment.

[Chemical formula 1]

(1)

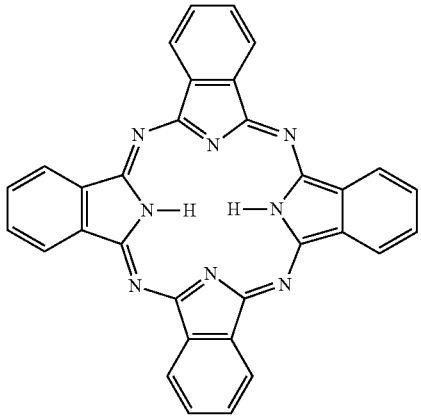

CGM-2

[Chemical formula 2]

(2)

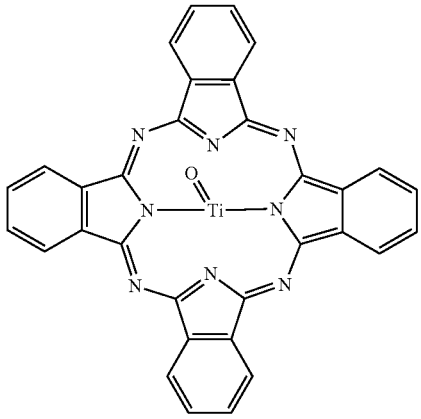

CGM-1

Each of these charge generating agents described above may be used alone, or a combination of two or more of these charge generating agents may be used, so as to provide an absorption wavelength in a desired region. Digital optical image forming apparatuses such as a laser beam printer that uses a semiconductor laser as a light source and a fax machine need a photoreceptor that has a sensitivity in at least 700 nm wavelength region, and therefore a phthalocyanine pigment, such as a metal-free phthalocyanine or oxo-titanyl phthalocyanine, is suitably applied thereto. Note that the crystal forms of the phthalocyanine pigments are not particularly limited, and therefore various forms can be used. Analog optical image forming apparatuses such as a static copy machine that uses halogen lamp as a white light source need a photoreceptor that has a sensitivity in a visible region, and therefore a perylene pigment, a bis-azo pigment or the like can be suitably applied thereto.

(Charge Transport Agent)

The charge transport agent is not particularly limited as long as it can be used as a charge transport agent included in a photosensitive layer of a single layer type electrophotographic photoreceptor. The charge transport agent is, generally, a hole transport agent or an electron generate agent.

The hole transport agent is not particularly limited as long as it can be used as a hole transport agent included in a photosensitive layer of a single layer type electrophotographic photoreceptor. Specific examples thereof include benzidine derivative, an oxadiazol compound such as 2,5-di(4-methylaminophenyl)-1,3,4-oxadiazol, a styryl compound such as 9-(4-diethylamino styryl)anthracene, a carbazole compound such as polyvinyl carbazole, an organic polysilane compound, a pyrazoline compound such as 1-phenyl-3-(p-dimethylamino phenyl) pyrazoline, a hydrazone compound, a triphenylamine compound, an indole compound, an oxazole compound, an isoxazole compound, a triazole compound, a thiadiazole compound, an imidazole compound, a pyrazole compound, a triazole compound and other nitrogen-containing cyclic compounds, as well as condensed polycyclic compounds. Above all, the triphenylamine compound is preferred, and triphenylamine compounds expressed by the following formulae (3) to (11) are particularly preferred.

[Chemical formula 3]

(3)

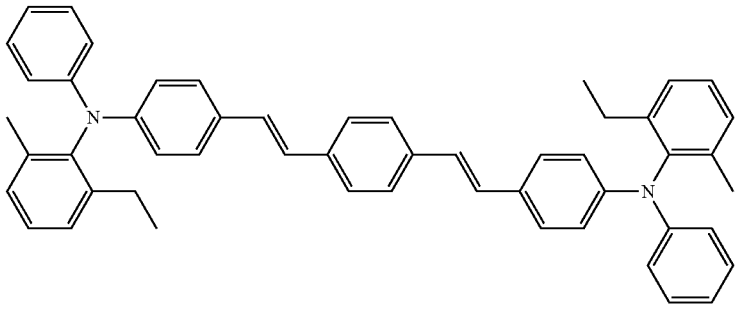

HTM-1

[Chemical formula 4]

(4)

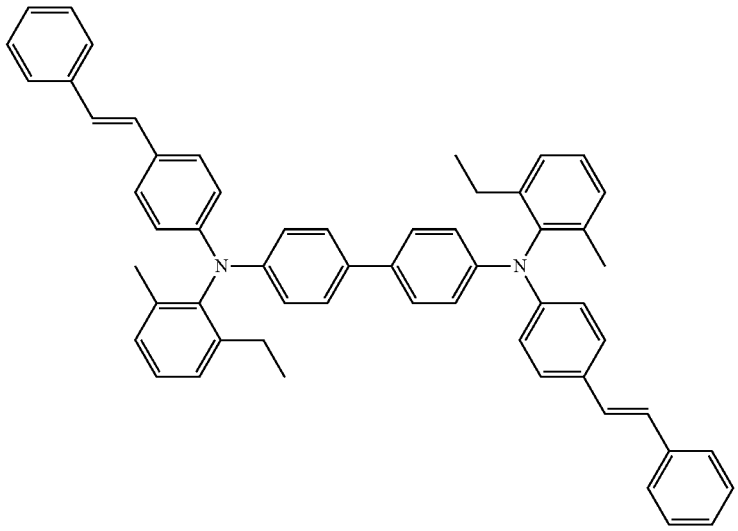

HTM-2

-continued
[Chemical formula 5]
(5)
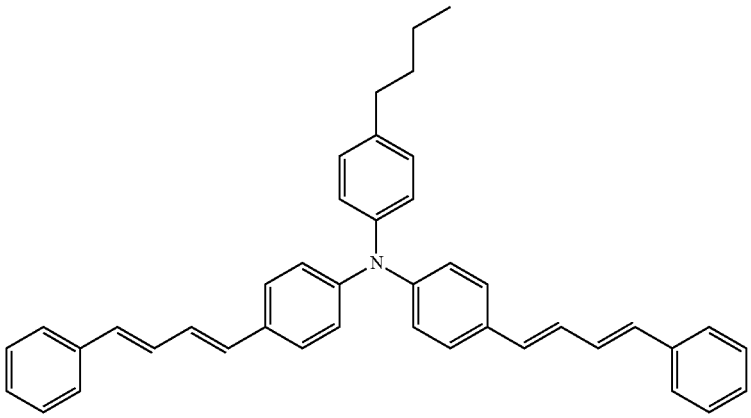
HTM-3
[Chemical formula 6]
(6)
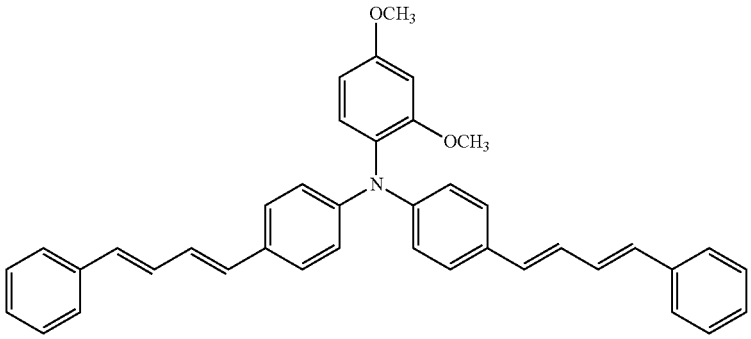
HTM-4
[Chemical formula 7]
(7)
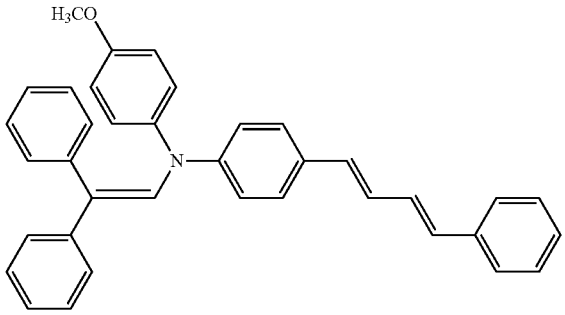
HTM-5

-continued
[Chemical formula 8]
(8)
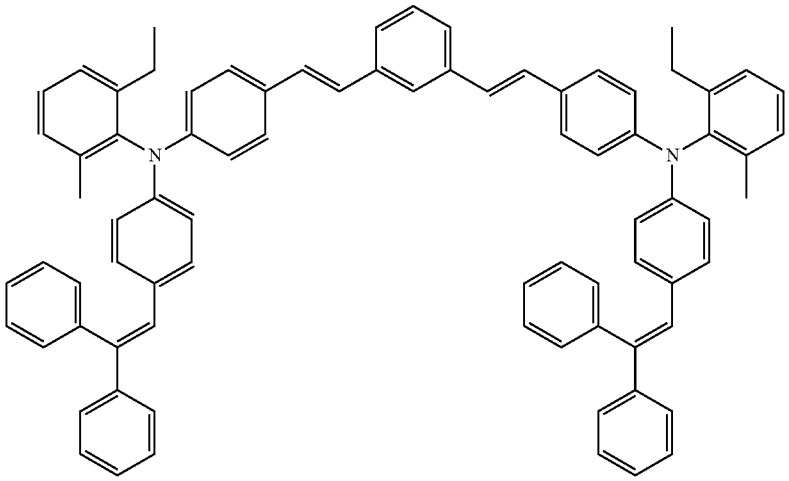
HTM-6
[Chemical formula 9]
(9)
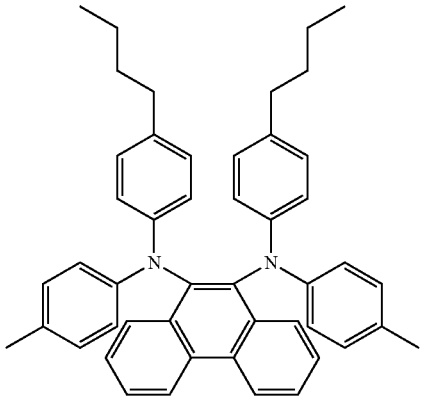
HTM-7
[Chemical formula 10]
(10)
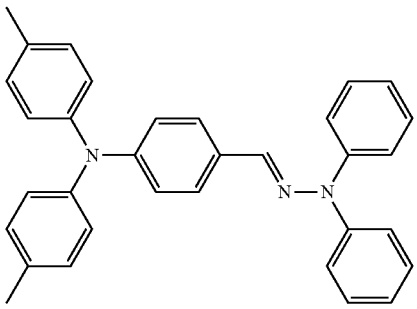
HTM-8

-continued

[Chemical formula 11]

(11)

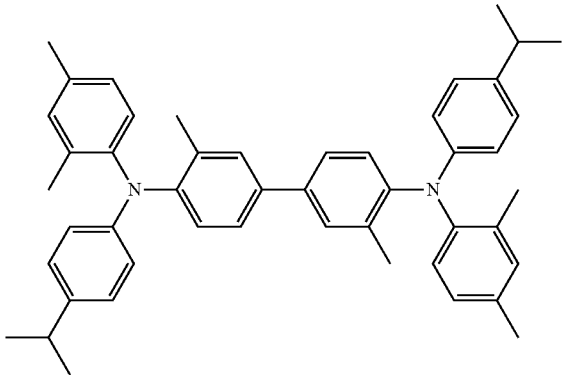

HTM-9

Each of these hole transport agents may be used alone, or a combination of two or more of these hole transport agents may be used.

The electron transport agent is not particularly limited as long as it can be used as an electron transport agent contained in a photosensitive layer of a single layer type electrophotographic photoreceptor. Specific examples of the electron transport agent include quinone derivatives such as naphthoquinone derivative, diphenoquinone derivative, anthraquinone derivative, azo-quinone derivative, nitroanthraquinone derivative and dinitroanthraquinone derivative, malononitrile derivative, thiopyran derivative, trinitrothioxanthone derivative, 3,4,5,7-tetranitro-9-fluorenone derivative, dinitroanthracene derivative, dinitroacridine derivative, tetracyanoethylene, 2,4,8-trinitrothioxanthone, dinitrobenzene, dinitroanthracene, dinitroacridine, succinic anhydride, maleic anhydride, and dibromo maleic anhydride. Above all, the quinone derivatives are preferred, and quinone derivatives expressed by the following formulae (12) to (14) are more preferred.

[Chemical formula 12]

(12)

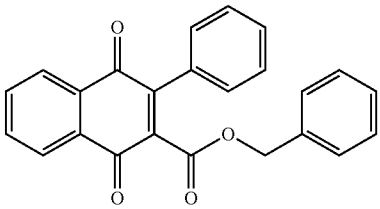

ETM-1

[Chemical formula 13]

(13)

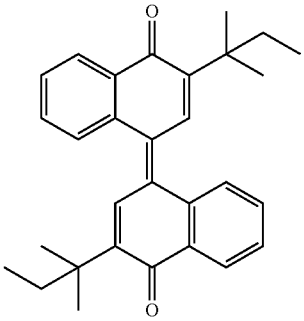

ETM-2

-continued

[Chemical formula 14]

(14)

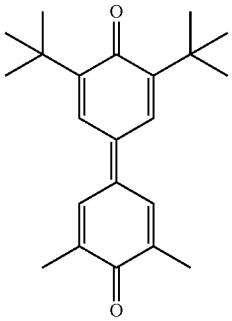

ETM-3

Each of these electron transport agents may be used alone, or a combination of two or more of these electron transport agents may be used.

(Binder Resin)

The binder resin is not particularly limited as long as it can be used as a binder resin of a single layer type electrophotographic photoreceptor that has a yield point strain of 9 to 29%. The peeling of the film of the photoreceptor can be prevented by using the binder resin having a yield point strain within this range. When the yield point strain is less than 9%, the film of the photoreceptor peels off easily. When, on the other hand, the yield point strain exceeds 29%, extraneous matters are formed on an image. It is considered that, as long as the yield point strain of the binder resin is within the range of 9 to 29%, the yield point strain of the photoreceptor surface layer falls within a range of 5 to 25%. Therefore, the above-mentioned effects can be achieved by preparing such a photoreceptor in which the yield point strain of the photoreceptor surface layer falls within this range, but it is easy to adjust the yield point strain of the binder resin in the abovementioned range.

Any resins may be used as the binder resin as long as its yield point strain falls within the range of 9 to 29%. Examples of the binder resin include polycarbonate resin, polyester resin, and polyarylate resin. The polycarbonate resin is preferred in terms of its compatibility with the hole transport agent or the electron transport agent.

Examples of the polycarbonate resin include a polycarbonate resin having a recurring unit, such as the ones expressed by the following formulae (15) to (17).

[Chemical formula 15]

(15)

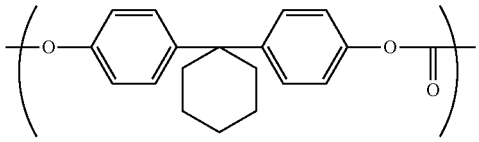

PC-Z

[Chemical formula 16]

(16)

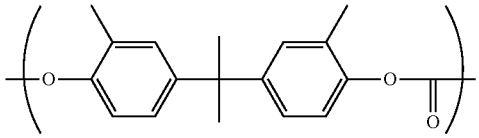

PC-C

[Chemical formula 17]

(17)

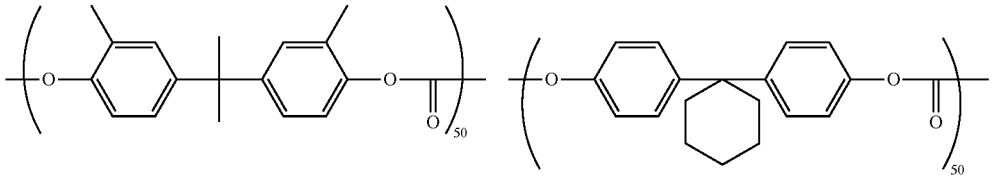

PC-C/PC-Z

The number "50" in the formula (17) indicates that this binder resin is copolymerized at a copolymerization ratio of 50%. More specifically, the polycarbonate resin having a recurring unit that is expressed by the formula (17) is obtained by copolymerizing the recurring unit expressed by the formula (15) and the recurring unit expressed by the formula (16), at a copolymerization ratio of 50%.

The number of recurring units in the polycarbonate resin is not particularly limited but is preferably such that it achieves the yield point strain of 9 to 29%.

In addition, when the polycarbonate resin is used as the binder resin, the viscosity-average molecular weight thereof is preferably 50,000 to 80,000, or more preferably 55,000 to 75,000.

When the viscosity-average molecular weight of the polycarbonate resin is excessively low, the effect of improving the antiwear properties of the polycarbonate resin cannot be produced adequately, wearing the photosensitive layer out easily. On the other hand, when the viscosity-average molecular weight of the polycarbonate resin is excessively high, the polycarbonate resin cannot be dissolved in a solvent. This makes it difficult to prepare application liquid for forming the photosensitive layer and consequently to form an excellent photosensitive layer. Furthermore, extraneous matters are likely to be formed on an image.

The binder resin is preferably constituted by the polycarbonate resin but may contain a resin other than the polycarbonate resin. The resin other than the polycarbonate resin is not particularly limited as long as it can be used as the binder resin of the photosensitive layer. Specific examples of the resin include styrene resin, styrene-butadiene copolymer, styrene-acrylonitrile copolymer, styrene-maleic copolymer, styrene-acrylic copolymer, acrylic copolymer, polyethylene resin, ethylene-vinyl acetate copolymer, chlorinated polyethylene resin, polyvinyl chloride resin, polypropylene resin, ionomer, vinyl chloride-vinyl acetate copolymer, polyester resin, alkyd resin, polyamide resin, polyurethane resin, polycarbonate resin, polyarylate resin, polysulfone resin, diallyl phthalate resin, ketone resin, polyvinyl butyral resin, polyether resin and other thermoplastic resins, silicone resin, epoxy resin, phenol resin, urea resin, melamine resin and other crosslinkable thermosetting resins, epoxy acrylate resin, as well as urethane-acrylate copolymer resin and other photocrosslinkable resins.

(Additives)

The photoreceptor may contain various additives other than the charge generating agent, the charge transport agent and the binder resin, so as not to negatively affect the electrophotographic characteristics thereof. Specific examples of the additives include degradation inhibitors such as antioxidant, radical scavenger, singlet quencher and ultraviolet absorber, softener, plasticizer, surface modifier, extender, thickener, dispersion stabilizer, wax, acceptor, donor, surfactant, and leveling agent. In order to improve the sensitivity of the photosensitive layer, terphenyl, halo naphthoquinones, acenaphthylene, or other known sensitizer may be combined with the charge generating agent.

[Method for Producing Single Layer Type Photoreceptor]

A method for producing the single layer type photoreceptor is described next.

The single layer type photoreceptor can be produced by applying application liquid on the conductive substrate by means of, for example, an application method and drying the application liquid. The application liquid being obtained by dissolving or dispersing the charge generating agent, the charge transport agent, the binding resin, and, if necessary, various additives in a solvent. Although not particularly limited, the application method can be, for example, a dip coating method. The drying method can be, for example, a method for drying the application liquid using hot air at 80 to 150 C.° for 15 to 120 minutes.

In the single layer type photoreceptor, the contents of the charge generating agent, the charge transport agent and the binder resin are selected appropriately and not particularly limited. Specifically, for example, the content of the charge generating agent is preferably 0.1 to 50 parts by mass or more preferably 0.5 to 30 parts by mass with respect to 100 parts by mass of the binder resin. The content of the electron transport agent is preferably 5 to 100 parts by mass or more preferably 10 to 80 parts by mass with respect to 100 parts by mass of the binder resin. The content of the hole transport agent is preferably 5 to 500 parts by mass or more preferably 25 to 200 parts by mass with respect to 100 parts by mass of the binder resin. The total quantity of the hole transport agent and the electron transport agent, which is the content of the charge transport agent, is preferably 20 to 500 parts by mass or more preferably 30 to 200 parts by mass with respect to 100 parts by mass of the binder resin. When containing an electron acceptable compound in the photosensitive layer, the content of the electron acceptable compound is preferably 0.1 to 40 parts by mass or preferably 0.5 to 20 parts by mass with respect to 100 parts by mass of the binder resin.

The thickness of the photosensitive layer of the single layer type photoreceptor is not particularly limited as long as it allows the photosensitive layer to function adequately. Specifically, for example, the thickness of the photosensitive layer is preferably 5 to 100 μm or more preferably 10 to 50 μm.

The solvent to be contained in the application liquid is not particularly limited as long each of the components described can be dissolved or dispersed in the solvent. Specific examples of the solvent include alcohols such as methanol, ethanol, isopropanol and butanol, aliphatic hydrocarbons such as n-hexane, octane and cyclohexane, aromatic hydrocarbons such as benzene, toluene and xylene, halogenated hydrocarbons such as dichloromethane, dichloroethane, carbon tetrachloride and chlorobenzene, ethers such as dimethyl ether, diethyl ether, tetrahydrofuran, ethylene glycol dimethyl ether and diethylene glycol dimethyl ether, ketones such as acetone, methyl ethyl ketone and cyclohexanone, esters such as ethyl acetate and methyl acetate, dimethylformaldehyde, dimethylformamide, and dimethylsulfoxide. Each of these solvents described above may be used alone, or a combination of two or more of these solvents may be used.

A method for creating the high-resistivity layer (interlayer) to be provided between the photosensitive layer and the conductive substrate is not particularly limited as long the method can form the high-resistivity layer on the conductive substrate. Specifically, for example, when the conductive substrate is an aluminum tube and the high-resistivity layer is an alumite layer, the method for creating the high-resistivity layer can be a method for anodizing the aluminum tube. More specifically, the method for creating the high-resistivity layer can be a method for performing the anodization by using sulfuric acid aqueous solution as electrolyte. In this case, the anodization time is preferably, for example, approximately 0.5 to 300 minutes. When using the sulfuric acid aqueous solution as the electrolyte, the concentration of the sulfuric acid aqueous solution is preferably, for example, approximately 0.1 to 80 mass %. Formation voltage used in the anodization is preferably, for example, approximately 10 to 200 V.

(Image Forming Apparatus)

Although not particularly limited, the image forming apparatus according to the present embodiment is an electrophotographic image forming apparatus that has the positively-charged single layer type electrophotographic photoreceptor and the contact charging device. Specific examples of the image forming apparatus according to the present embodiment include a tandem type color image forming apparatus that uses a plurality of colors of toners, such as the one described specifically hereinbelow.

Note that the image forming apparatus having the electrophotographic photoreceptor according to the present embodiment has a plurality of photoreceptors that are arranged in a predetermined direction so as to form toner images using different toner colors on surfaces thereof, and a plurality of developing devices with developing rollers, which are disposed facing the respective photoreceptors, carry the toners on the surfaces of the developing rollers, and supply the toners to the respective surfaces of the photoreceptors.

Figure 3:
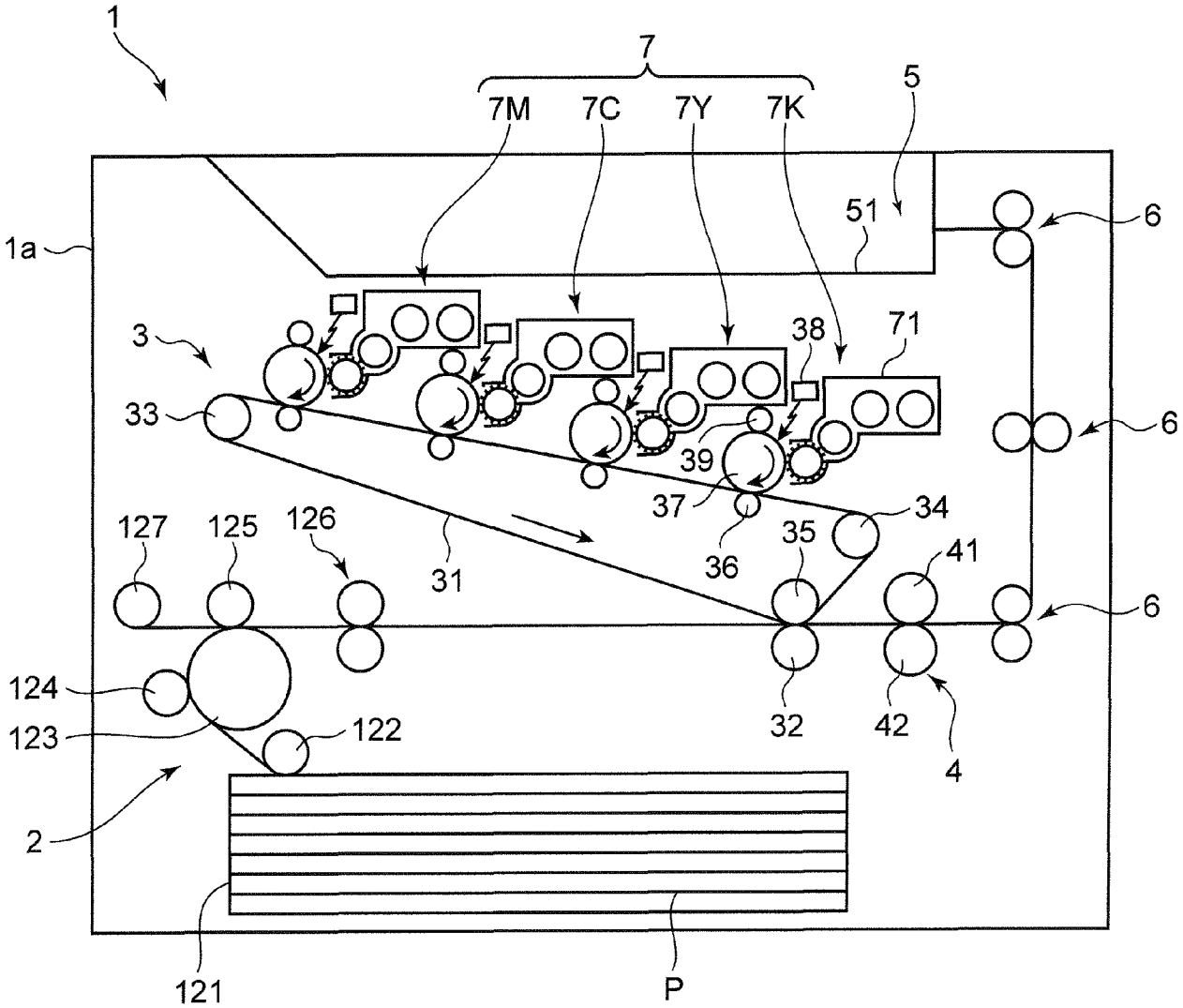
FIG. 3 is a schematic diagram showing a configuration of an image forming apparatus that has the positively-charged single layer type electrophotographic photoreceptor according to the embodiment of the present invention.

FIG. 3 is a schematic diagram showing a configuration of the image forming apparatus that has the positively-charged single layer type electrophotographic photoreceptor according to the embodiment of the present invention. In the description here, the image forming apparatus 1 is illustrated as a color printer 1.

As shown in FIG. 3, this color printer 1 has a box-shaped device main body 1*a*. The inside of the device main body 1*a* is provided with a sheet feeding part 2 for feeding sheets P, an image forming part 3 that transfers a toner image based on image data and the like to each of the sheet P while conveying the sheets P fed from the sheet P feeding part 2, and a fixing part 4 that performs a fixing process for fixing the unfixed toner image onto each sheet P transferred by the image forming part 3. An upper surface of the device main body 1*a* is provided with a sheet ejection part 5 that ejects the sheets P subjected to the fixing process by the fixing part 4.

The sheet feeding part 2 has a paper cassette 121, a pickup roller 122, sheet feeding rollers 123, 124, 125, and resist rollers 126. The paper cassette 121 for storing the sheets P in different sizes is provided so as to be detachable from the device main body 1*a*. The pickup roller 122, provided in the upper left position of the paper cassette 121 in FIG. 3, picks up the sheets P of the paper cassette 121 one by one. The sheet feeding rollers 123, 124, 125 send the sheets P picked up by the pickup roller 122, to a sheet conveying path. The resist rollers 126 temporarily holds each of the sheets P, which are sent to the sheet conveying path by the sheet feeding rollers 123, 124, 125, and then supplies each sheet P to the image forming part 3 at a predetermined timing.

The sheet feeding part 2 further has a manual tray, not shown, which is installed on the left-hand side of the device main body 1*a* in FIG. 3, and a pickup roller 127. The pickup roller 127 picks up the sheets P placed on the manual tray. The sheets P picked up by the pickup roller 127 are sent to the sheet conveying path by the sheet feeding rollers 123, 125, and supplied to the image forming part 3 at a predetermined timing by the resist rollers 126.

The image forming part 3 has an image forming unit 7, an intermediate transfer belt 31, to a surface (contact surface) of which the toner image based on the image data is primarily transferred by the image forming unit 7, the image data being electronically transmitted from a computer or the like, and a secondary transfer roller 32 for secondarily transferring the toner image on the intermediate transfer belt 31 to each of the sheets P sent from the paper cassette 121.

The image forming unit 7 has a black unit 7K, yellow unit 7Y, cyan unit 7C and magenta unit 7M, which are disposed sequentially from an upstream (right-hand side in FIG. 3) toward a downstream. In a central position of each of the units 7K, 7Y, 7C and 7M, a photoreceptor drum 37 serving as an image carrier is disposed so as to be rotatable in a direction of an arrow (clockwise). A charging device 39, exposure device 38, developing device 71, cleaning device, not shown, and a destaticizer serving as destaticizing means are disposed sequentially from a rotational direction upstream around each of the photoreceptor drums 37. The electrophotographic photoreceptor described earlier is used as each photoreceptor drum 37.

The charging device 39 uniformly charges a circumferential surface of the corresponding photoreceptor 37 that rotates in the direction of the arrow. Contact charging devices (charging rollers) such as the one described earlier are used as the charging devices 39.

The exposure device 38, a so-called laser scanning unit, irradiates the corresponding circumferential surface of the photoreceptor drum 37, which is uniformly charged by the charging device 39, with a laser beam based on the image data that are input from a personal computer (PC), which is a host device, so as to form an electrostatic latent image based on the image data, on the photoreceptor drum 37. The developing device 71 forms the toner image based on the image data, by supplying the corresponding toner to the circumferential surface of the photoreceptor drum 37 on which the electrostatic latent image is formed. Then, the toner image is primarily transferred to the intermediate transfer belt 31. After completion of the primary transfer of the toner image to the intermediate transfer belt 31, the cleaning device cleans the toner remaining on the circumferential surface of the photoreceptor drum 37. After completion of the primary transfer, the destaticizer destaticizes the circumferential surface of the photoreceptor drum 37. After being cleaned by the cleaning device and the destaticizer, the circumferential surface of the photoreceptor drum 37 prepares for a new charging process performed by the charging device.

The intermediate transfer belt 31, an endless belt-like rotating body, is wrapped around a plurality of rollers such as a driving roller 33, driven roller 34, backup roller 35 and primary transfer rollers 36, in a manner that a surface (contact surface) of the intermediate transfer belt 31 abuts on the circumferential surface of each photoreceptor drum 37. The intermediate transfer belt 31 is also configured to be rotated endlessly by the plurality of rollers while being pressed against the photoreceptor drums 37 by the photoreceptor drums 37 and the primary transfer rollers 36. The driving roller 33 is driven to rotate by a drive source such as a stepping motor, to provide drive power for endlessly rotating the intermediate transfer belt 31. The driven roller 34, the backup roller 35 and the primary transfer rollers 36, provided rotatably, are rotated following the endless rotation of the intermediate transfer belt 31 caused by the driving roller 33. These rollers 34, 35, 36 are rotated following the main rotation of the driving roller 33, via the intermediate transfer belt 31, and support the intermediate transfer belt 31.

The primary transfer roller 36 applies a primary transfer bias (having a polarity opposite a toner charging polarity) to the intermediate transfer belt 31. Accordingly, the toner images formed on the photoreceptor drums 37 are superimposed sequentially (primary transfer) on the intermediate transfer belt 31 that revolves between the photoreceptor drums 37 and the primary transfer rollers 36 in a direction of an arrow (counterclockwise) by means of the drive of the driving roller 33.

The secondary transfer roller 32 applies a secondary transfer bias having a polarity opposite the polarity of the toner images, to each of the sheets P. Accordingly, the toner images that are primarily transferred onto the intermediate transfer belt 31 are transferred to each of the sheets P between the secondary transfer roller 32 and the backup roller 35. As a result, a color transfer image (unfixed toner images) is transferred to each of the sheets P.

The fixing part 4 performs the fixing process on the image transferred onto each sheet P by the image forming part 3. The fixing part 4 has a heat roller 41 heated by an electric heat generating body, and a pressure roller 42, which is disposed facing the heat roller 41 and a circumferential surface of which comes into press contact with a circumferential surface of the heat roller 41.

The image transferred to each sheet P by the secondary transfer roller 32 in the image forming part 3 is fixed to the sheet P by the fixing process that uses heat generated as the sheet P passes between the heat roller 41 and the pressure roller 42. After the fixing process, the sheet P is ejected to the sheet ejection part 5. In addition, in the color printer 1 of the present embodiment, conveying rollers 6 are disposed in appropriate places between the fixing part 4 and the sheet ejection part 5.

The sheet ejection part 5 is formed into a concave shape at a top part of the device main body 1*a* of the color printer 1. A catch tray 51 for receiving the ejected sheets P is formed at a bottom part of this concave part.

The image forming apparatus 1 can form suitable images on the sheets P by the following image formation operations. Because the tandem type image forming apparatus described above has the photoreceptors as image carriers and the charging rollers as the charging devices, the image forming apparatus that has resistant photosensitive layers can be made extremely highly durable, although the charging devices thereof are of contact type.

EXAMPLES

The present invention is described hereinafter more specifically using examples, but the present invention is not at all limited to these examples.

Experimental Example 1

Example 1

The photoreceptors and the charging devices of FS-05300DN (A4 color printer) manufactured by Kyocera Mita Japan Corporation were modified as follows so as to obtain an image forming apparatus.

(Photoreceptors)

Positively-charged single layer photoreceptors with a diameter of 30 mm and film thickness of 30 μm The charge generating agent (metal-free phthalocyanine expressed by the formula (1) described above) in an amount of 5 parts by mass, the hole transport agent (HTM-3, expressed by the chemical formula (5) described above) in an amount of 50 parts by mass, the electron transfer agent (ETM-2, expressed by the chemical formula (13) described above) in an amount of 35 parts by mass, and the binder resin (viscosity-average molecular weight is 75,000, the yield point strain is 29%), expressed by the chemical formula (15) described above, in an amount of 100 parts by mass were mixed and dispersed in 800 parts by mass of tetrahydrofuran using the ball mill for 50 hours, to prepare photoreceptor application liquid. This application liquid was applied onto the conductive substrate by means of the dip coating method. Thereafter, the conductive substrate with the application liquid thereon was dried by hot air at 100 C.° for 40 minutes, to obtain a photoreceptor having a film thickness of 30 μm (diameter is 30 mm).

(Charging Devices)

Charging rollers:

Diameter ϕ: 12 mm, Thickness of conductive layer: 2 mm

Conductive layer: Epichlorohydrin rubber (manufactured by Tokai Rubber Industries, Ltd.)

Ion conductive agent: Contained

Resin coating: Nylon resin (thickness: approximately 10 μm)

Example 2

Other than the fact that the thickness of the conductive layer of each charging roller was changed to 1 mm, the image forming apparatus was obtained in the same manner as example 1.

Example 3

Other than the fact that the thickness of the conductive layer of each charging roller was changed to 3 mm, the image forming apparatus was obtained in the same manner as example 1.

Comparative Example 1

The photoreceptors and the charging devices of FS-05300DN (A4 color printer) manufactured by Kyocera Mita Japan Corporation were modified as follows so as to obtain an image forming apparatus.

(Photoreceptors)

Positively-charged single layer photoreceptors with a diameter of 30 mm and film thickness of 30 μm The charge generating agent (metal-free phthalocyanine expressed by the formula (1) described above) in an amount of 5 parts by mass, the hole transport agent (HTM-3, expressed by the chemical formula (5) described above) in an amount of 50 parts by mass, the electron transfer agent (ETM-2, expressed by the chemical formula (13) described above) in an amount of 35 parts by mass, and the binder resin (viscosity-average molecular weight is 47,000, the yield point strain is 7.8%), expressed by the chemical formula (15) described above, in an amount of 100 parts by mass were mixed and dispersed in 800 parts by mass of tetrahydrofuran using the ball mill for 50 hours, to prepare photoreceptor application liquid. This application liquid was applied onto the conductive substrate by means of the dip coating method. Thereafter, the conductive substrate with the application liquid thereon was dried by hot air at 100 C.° for 40 minutes, to obtain a photoreceptor having a film thickness of 30 μm (diameter is 30 mm).

(Charging Devices)

Other than the fact that the thickness of the ion conductive layer (epichlorohydrin layer) was 0.5 mm and that the other conductive layer (SBR: styrene-butadiene rubber layer) (manufactured by Tokai Rubber Industries, Ltd.) was increased by 1.5 mm, the same charging rollers as those obtained in example 1 were used.

[Evaluation]

The following evaluation tests were carried out using the image forming apparatuses described above.

(Degree of Peeling of the Photoreceptor Films)

Figure 4:
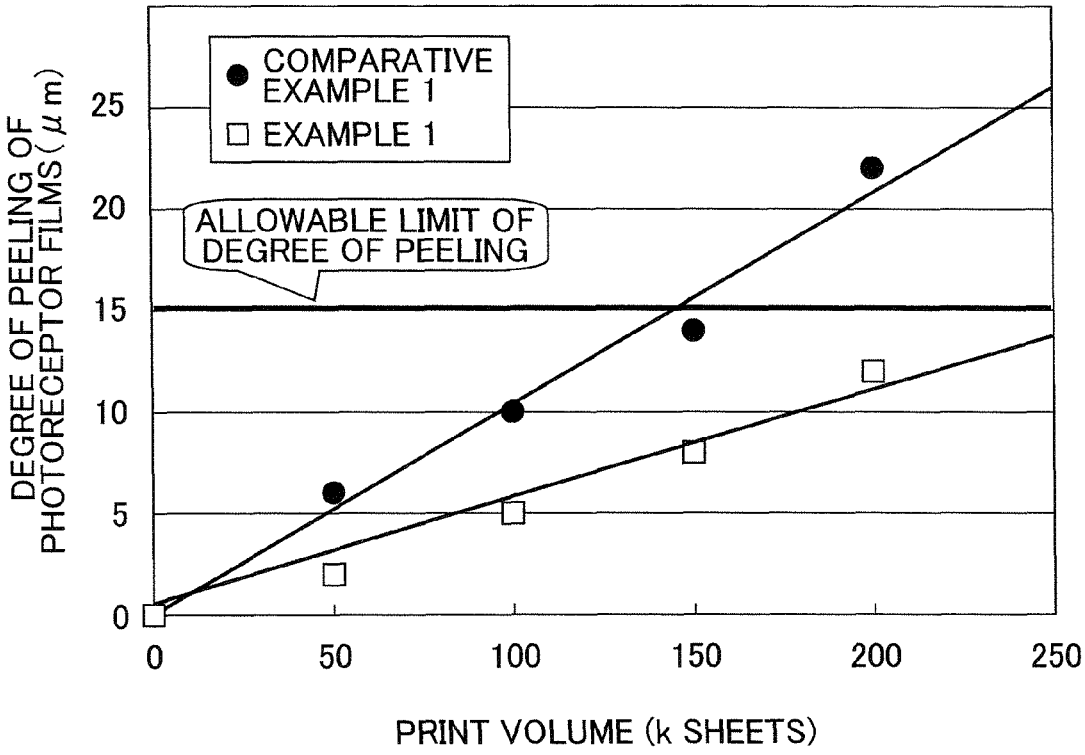
FIG. 4 is a graph illustrating the degrees of peeling of a film of the photoreceptor according to experimental example 1.

Original document was printed out continuously on A4-size transfer sheets at a printing ratio of 4% by using the color printers described above, and the thickness of each photoreceptor was measured periodically in order to examine the relationship between the number of prints and the degree of peeling of the films of the photoreceptors. The thickness of each film was measured using MMS 3AM manufactured by Fischer Instruments. The results are shown in FIG. 4. Note that the allowable limit of the degree of peeling shown in the graph represents the limit of the thickness at which the photosensitive layer might cause dielectric breakdown at certain charged voltage.

Compared to the image forming apparatus obtained in comparative example 1, in the image forming apparatus of example 1 the allowable limit was not exceeded even when the number of prints exceeded 200,000. Therefore, it was found that the image forming apparatus according to the embodiments of the present invention had a long life.

(Upper Limit Resistance Value)

Other than the fact that the resistance values were changed to the resistance values shown in Table 1, the same charging rollers as those of example 1 were used in order to examine the relationship between each charging roller and the surface potential. The resistance value of each charging roller was converted from the value of a current that was obtained when pressing each charging roller against an aluminum pipe with no photosensitive layer at 500 gf and applying 500 V voltage to the shaft of the charging roller while rotating the charging roller at a circumferential speed of 170 mm/s. The voltage was applied by a high-voltage power supply model 610B, manufactured by TREK Corporation, and the current value was measured by connecting small portable ammeters 2051 of Yokogawa Meters & Instruments Corporation in series between a DC power and each charging roller. The potential on the surface of the photoreceptor was measured using a surface electrometer model 344 manufactured by TREK Corporation. At this moment, the voltage applied to the charging roller was 1.3 KV.

Figure 5:
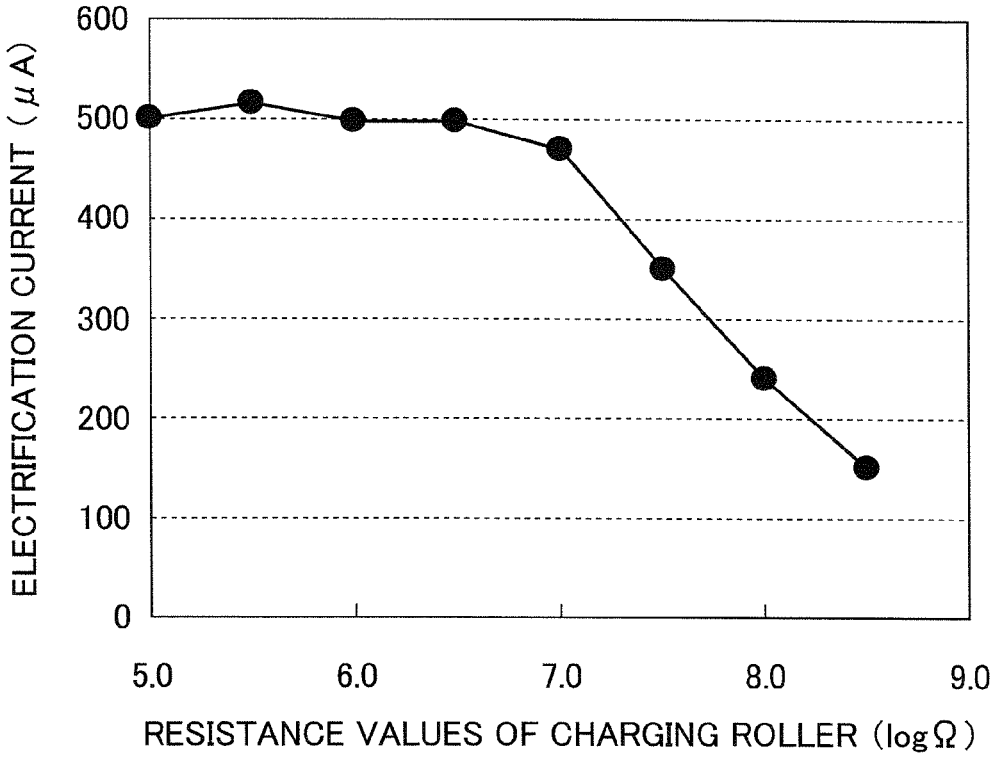
FIG. 5 is a graph illustrating a relationship of surface potentials to charging roller resistances according to experimental example 1.

The results are shown in Table 1 and FIG. 5.

TABLE 1

| RESISTANCE VALUES OF CHARGING ROLLER | SURFACE POTENTIALS |
|---|---|
| 5.0 | 500 |
| 5.5 | 515 |
| 6.0 | 497 |
| 6.5 | 498 |
| 7.0 | 470 |
| 7.5 | 350 |
| 8.0 | 240 |
| 8.5 | 150 |

As is clear from Table 1 and FIG. 5, the surface potential decreases when the resistance value of each charging roller exceeds $10^7\Omega$. It was found that the resistance of each charging roller varies depending on its circumference and axial direction and that the variation in the resistance easily leads to variation in the surface potential when the resistance value exceeds $10^7\Omega$. Therefore, the upper limit of the resistance of the charging roller was $10^7\Omega$.

(Number of Prints and Charging Roller Resistance Value)

Figure 6:
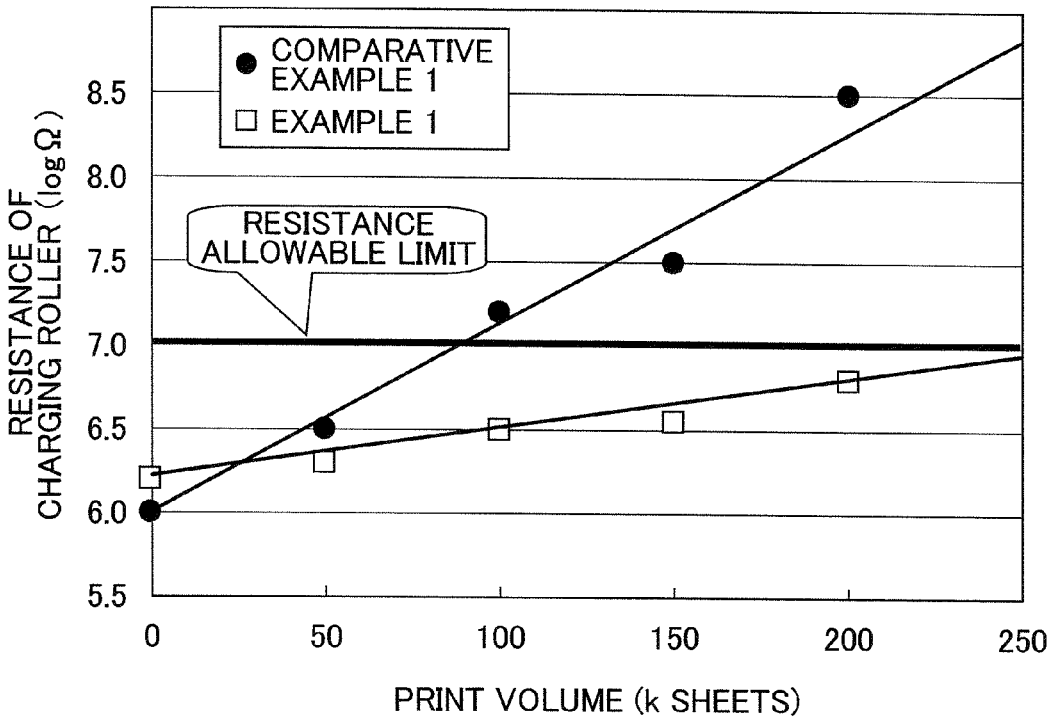
FIG. 6 is a graph illustrating a relationship of the charging roller resistances to the number of prints according to experimental example 1.

Original document was printed out continuously on A4-size transfer sheets at a printing ratio of 4% by using the color printer described above, and the resistance values of the charging rollers were periodically measured in order to examine the relationship between the number of prints and increase in the resistance values of the charging rollers. The resistances of the charging rollers were measured using the method described above. The results are shown in FIG. 6.

According to this evaluation test as well, the resistance of each charging roller has reached the upper limit resistance before the number of prints reaches 100,000 in the image forming apparatus obtained in comparative example 1, but the image forming apparatus obtained in example 1 lasted long as the resistance of each charging roller did not reach the upper limit even after making 200,000 prints.

(Current Values and Resistance Values of the Charging Rollers)

The charging rollers of examples 1 to 3 and comparative example 1 are rotated at 170 mm/s while pressing the charging rollers against aluminum pipes having a diameter or 30 mm. Constant current was applied to the shaft of each charging roller by using a high-voltage power supply model 610B, manufactured by TREK Corporation, to measure the resistance values of the charging rollers for 130 hours (200 k pages). The resistance values of the charging rollers were measured using the method described above. The results are shown in Table 2 and FIG. 7.

TABLE 2

| | THICKNESS 0.5 mm | THICKNESS 1.0 mm | THICKNESS 2.0 mm | THICKNESS 3.0 mm |
|---|---|---|---|---|
| 10 | 5.4 | 5.5 | 5.6 | 5.5 |
| 20 | 6.2 | N/A | 5.7 | N/A |
| 40 | 8 | 6.3 | 5.9 | N/A |
| 50 | 10 | N/A | N/A | N/A |
| 60 | | 6.9 | 6.3 | 5.9 |
| 80 | | 8.2 | 6.7 | N/A |
| 100 | | | 7.3 | 6.7 |
| 120 | | | | 7.3 |
| 130 | | | | |

Figure 7:
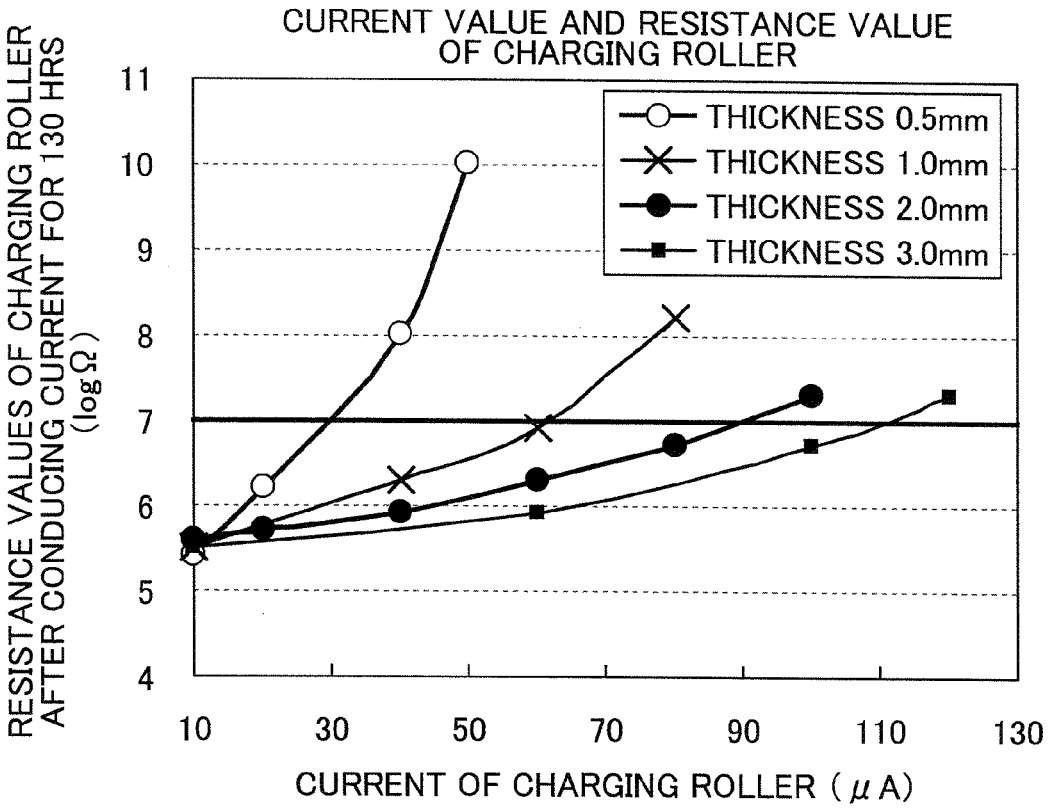
FIG. 7 is a graph illustrating a relationship between an average electrification current of electrification currents used until the end of the life-span of the photoreceptor and resistance values of the charging roller that are obtained upon the end of the life-span, according to experimental example 1.

As shown in Table 2 and FIG. 7, when the thickness of each charging roller was 0.5 mm, the resistance value thereof reaches the upper resistance ($10^7\Omega$) as soon as an average current of 30 μA or higher was applied. However, it was found that within thickness of 1.0 to 3.0 mm, the resistance value of each charging roller did not reach the upper limit resistance even when an average current of 60 μA or higher was applied. Because the higher the average current value, the more the pages can be printed out, it was found that the optimal thickness of the conductive layer of each charging roller was 1 to 3 mm.

(Electrification Current and Charge Amount of Each Photoreceptor)

Original document was printed out continuously on A4-size transfer sheets at a printing ratio of 4% by using the color printer described above, to periodically measure the values of currents flowing to the charging rollers (=to the photoreceptors). Small portable ammeters 2051 of Yokogawa Meters & Instruments Corporation were connected in series between a high-voltage substrate of an experimental machine and each charging roller, to measure the electrification currents while monitoring the electrification currents anytime during the execution of the printing.

Figure 8:
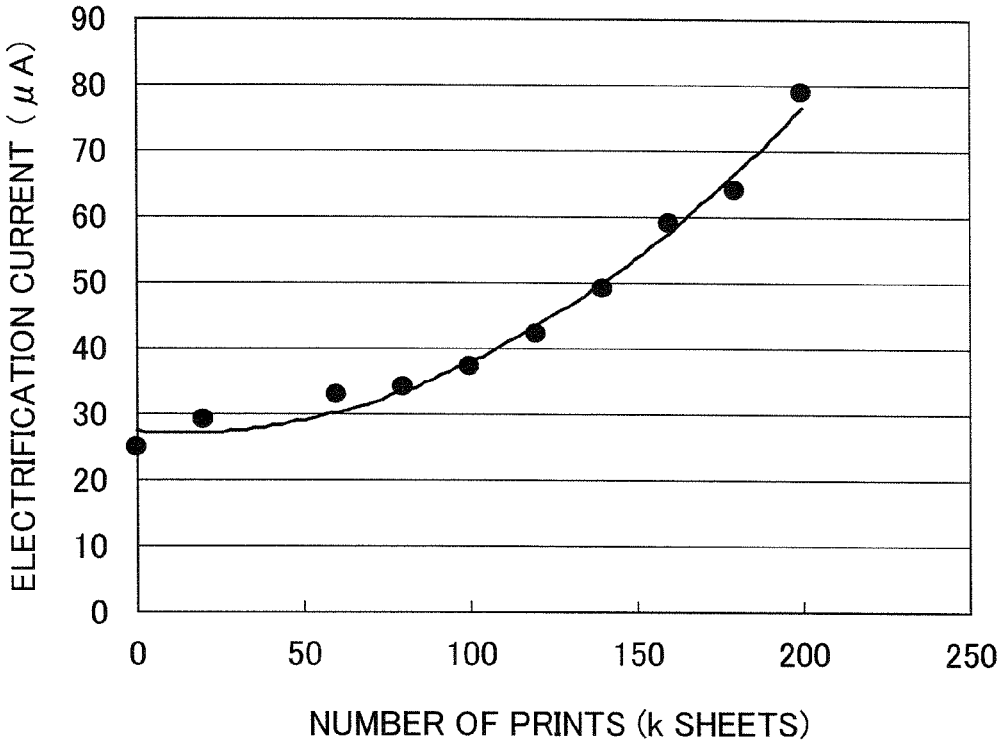
FIG. 8 is a graph illustrating a relationship of the number of prints to electrification current values of the photoreceptor according to experimental example 1.
Figure 9:
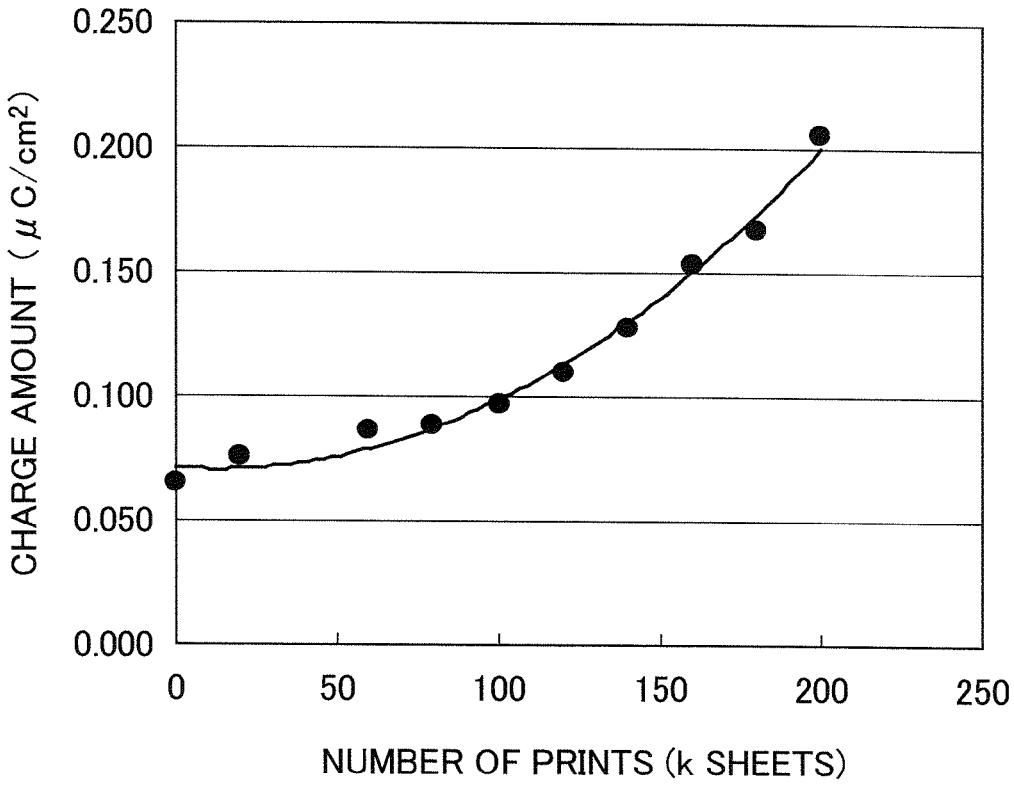
FIG. 9 is a graph showing a relationship of the number of prints to charge amounts of the photoreceptor according to experimental example 1.

The results are shown in Table 3 (electrification currents), Table 4 (charge amount), FIG. 8 (electrification currents) and FIG. 9 (charge amount). The charge amount was calculated under the conditions that "the electrification length is 226 mm" and "the circumferential speed of each photoreceptor is 170 mm/s."

TABLE 3

| NUMBER OF PRINTS (k SHEETS) | ELECTRIFICATION CURRENT (PRESENT INVENTION) |
|---|---|
| 0 | 25 |
| 20 | 29 |
| 60 | 33 |
| 80 | 34 |
| 100 | 37 |
| 120 | 42 |
| 140 | 49 |
| 160 | 59 |
| 180 | 64 |
| 200 | 79 |
| AVERAGE | 45.1 |

TABLE 4

| NUMBER OF PRINTS (k SHEETS) | ACTUAL CURRENT (μA) | CHARGE AMOUNT ($\mu C/cm^2$) |
|---|---|---|
| 0 | 25 | 0.065 |
| 20 | 29 | 0.075 |
| 60 | 33 | 0.086 |
| 80 | 34 | 0.088 |
| 100 | 37 | 0.096 |
| 120 | 42 | 0.109 |
| 140 | 49 | 0.128 |
| 160 | 59 | 0.154 |
| 180 | 64 | 0.167 |
| 200 | 79 | 0.206 |

As shown in Tables 3 and 4 and FIGS. 8 and 9, in the image forming apparatus of example 1 the average current value of the currents applied to the photoreceptors was approximately 45 μA until the number of prints reached 200,000. In other words, the current values increase as the peeling of the films of the photoreceptors advances. However, in the image forming apparatus according to the present invention, the average current values reaches 45 μA only after the number of prints exceeds 200,000. Therefore, an extremely large current can be applied to the photoreceptors (a large number of pages can be printed out).

Experimental test 2 (Yield point strain of the photoreceptors):

Examples 4 to 6, Comparative Examples 2 to 4

(Method for Producing Photoreceptor)

The charge generating agent (metal-free phthalocyanine expressed by the formula (1) described above) in an amount of 5 parts by mass, the hole transport agent (HTM-3, expressed by the chemical formula (5) described above) in an amount of 50 parts by mass, the electron transfer agent (ETM-2, expressed by the chemical formula (13) described above) in an amount of 35 parts by mass, and each binder resin, expressed by the following Table 2, in an amount of 100 parts by mass were mixed and dispersed in 800 parts by mass of tetrahydrofuran using a ball mill for 50 hours, to prepare photoreceptor application liquid. This application liquid was applied onto the conductive substrate by means of the dip coating method. Thereafter, the conductive substrate with the application liquid thereon was dried by hot air at 100° C. for 40 minutes, to obtain a photoreceptor having a film thickness of 30 μm (diameter is 30 mm). Examples 4 to 6 and comparative examples 2 to 4 represent the photoreceptors obtained according to the contained binder resins.

(Evaluation)

The yield point strain of each photoreceptor surface layer and each binder resin was measured using a viscoelasticity measuring instrument ("DMA-Q800," manufactured by TA Instruments) under the following evaluation conditions.

Initial load: 1 N

Measurement temperature: 30 C.°

Strain rate: 0.5%/minute (Sampling interval: every 2 seconds)

Next, the prepared photoreceptors were mounted in a printer FS-1300D, manufactured by Kyocera Mita Japan Corporation, and a printing test was carried out on 50,000 pages, to evaluate the degree of peeling of the photosensitive layers (μm). Through this image evaluation, formation of extraneous matters was evaluated.

Figure 10:
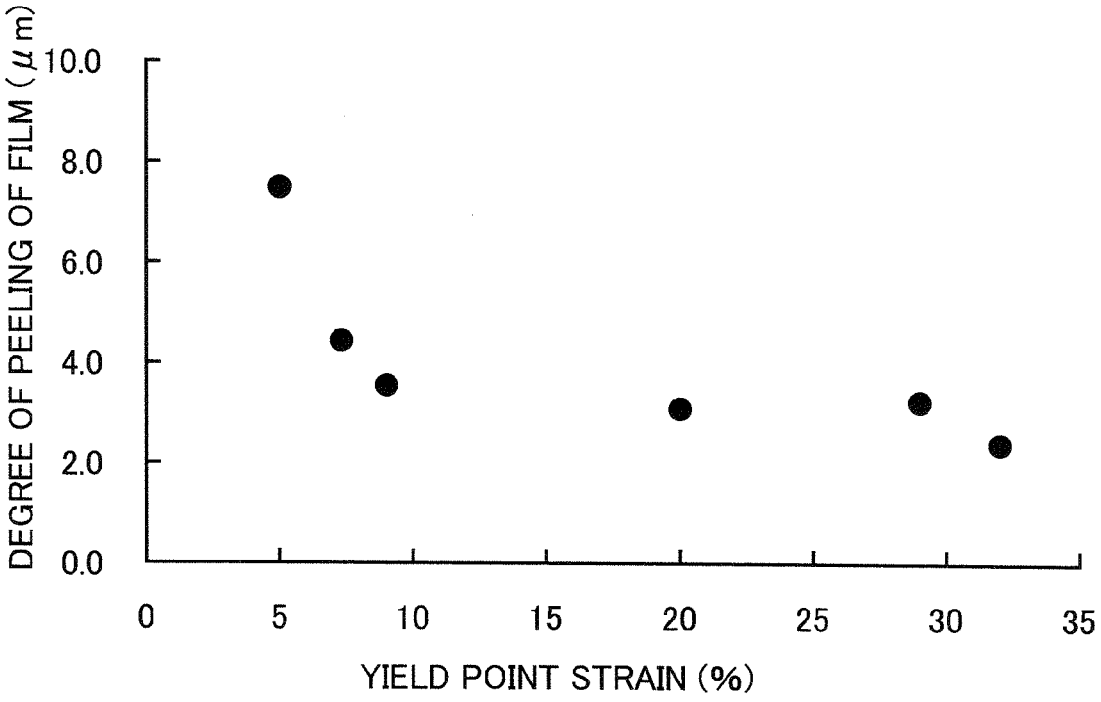
FIG. 10 is a graph illustrating a relationship of degrees of peeling of the film of the photoreceptor to yield point strains of a binder resin contained in the photoreceptor according to experimental example 2.

The results are shown in Table 5. FIG. 10 shows a relationship between the degree of peeling of the film of each photoreceptor and the yield point strain of each binder resin contained in each photoreceptor.

TABLE 5

| | RESIN TYPE | MOLECULAR WEIGHT Mv | YIELD POINT STRAIN/% PHOTORECEPTORS | YIELD POINT STRAIN/% RESINS | DEGREE OF PEELING OF FILM | EVALUATION ON FORMATION OF EXTRANEOUS MATTERS |
|---|---|---|---|---|---|---|
| EXAMPLE 4 | PC-Z | 75000 | 23.0 | 29.0 | 3.25 | NO |
| EXAMPLE 5 | PC-Z | 67000 | 14.00 | 20.0 | 3.10 | NO |
| EXAMPLE 6 | PC-C/PC-Z | 55000 | 7.10 | 9.0 | 3.52 | NO |
| COMPARATIVE EXAMPLE 2 | PC-Z | 30000 | 2.94 | 7.3 | 4.56 | NO |
| COMPARATIVE EXAMPLE 3 | PC-C | 48000 | 2.40 | 5.0 | 7.48 | NO |
| COMPARATIVE EXAMPLE 4 | PC-Z | 80000 | 27 | 32 | 2.40 | YES |

[Discussions]

As is clear from FIGS. 4 and 6 according to experimental example 1, compared to the conventional image forming apparatus (comparative example 1), it was found in the image forming apparatus of example 1 according to the present invention that, no matter how many pages were printed out, the photoreceptors and the charging rollers showed extremely high durability without having the degree of peeling of the films of the photoreceptors or the resistance value of the charging rollers exceed the allowable limit. Moreover, FIG. 7 shows that, in the image forming apparatuses of example 1 to 3 according to the present invention, a large current can be applied to the charging rollers without having the resistance of thereof reach the upper limit resistance for a long period of time.

Such long-lasting image forming apparatus did not exist in the prior art. It was proven that the image forming apparatus according to the present invention is far more durable than the image forming apparatus of comparative example 1 (the yield point strain of the binder resin of each photoreceptor falls outside of the ranges described in the present invention, and the thickness of the conductive layer of each charging roller is less than 1 mm).

In addition, as shown in FIG. 10, use of the photoreceptors that contain the binder resins having a yield point strain of 9 to 29% (the yield point strain of each photoreceptor surface layer is 5 to 25%) can prevent the peeling of the film of each photoreceptor and formation of extraneous matters on formed images.

The results described above show that the present invention can obtain an image forming apparatus that has long-lasting photoreceptors and charging devices, produces less ozone and has excellent environmental responsiveness.

This application is based on Japanese Patent application Nos. 2010-129124 and 2010-289758 filed in Japan Patent Office on Jun. 4, 2010 and Dec. 27, 2010, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus, comprising:

a positively-charged single layer type electrophotographic photoreceptor;

a charging device that has a contact charging member for charging a surface of the photoreceptor;

an exposure device for exposing the charged surface of the photoreceptor to light to form an electrostatic latent image on the surface of the photoreceptor;

a developing device for developing the electrostatic latent image into a toner image; and a transfer device for transferring the toner image from the photoreceptor to a transferred body, wherein the positively-charged single layer type electrophotographic photoreceptor has a conductive substrate and a photosensitive layer, the photosensitive layer contains a charge generating agent, a charge transport agent and a binder resin together, the binder resin having a yield point strain of 9 to 29%, the contact charging member is a charging roller that has a conductive layer with a thickness of 1 mm to 3 mm, and the binder resin is a polycarbonate resin having a viscosity-average molecular weight of 55,000 to 75,000 and a recurring unit expressed by one of the formulae (15) to (17):

[Chemical formula 15]

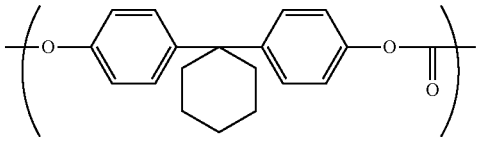

(15)

PC-Z

-continued

[Chemical formula 16]

(16)

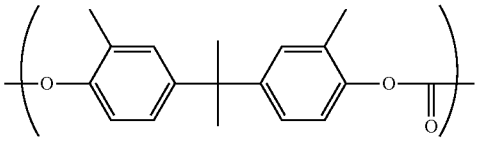

PC-C

[Chemical formula 17]

(17)

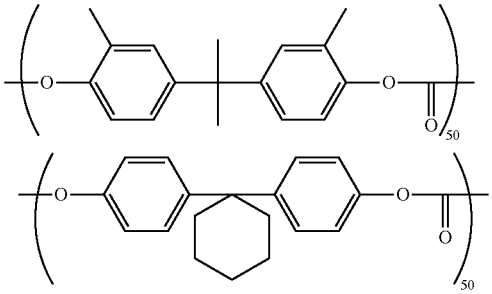

PC-C/PC-Z wherein the number "50" in the formula (17) indicates that the binder resin of the formula (17) is copolymerized at a copolymerization ratio of 50%.

2. The image forming apparatus according to claim 1, wherein an initial electric resistance value of the charging roller is $10^5$ to $10^6\Omega$.

3. The image forming apparatus according to claim 1, wherein the conductive layer is an ion conductive rubber layer.

4. The image forming apparatus according to claim 1, wherein the conductive layer is an ion conductive rubber layer that is made of epichlorohydrin rubber containing an ion conductive agent.

5. The image forming apparatus according to claim 1, wherein a high-resistivity layer is provided between the photosensitive layer and the conductive substrate of the positively-charged single layer type electrophotographic photoreceptor.

* * * * *